United States Patent [19]

Davey

[11] Patent Number: 4,679,692

[45] Date of Patent: Jul. 14, 1987

[54] CONTAINERS FOR COSMETICS

[75] Inventor: Brian Davey, North Shields, England

[73] Assignee: Lion Brush Works Limited, Newcastle-upon-Tyne, England

[21] Appl. No.: 692,587

[22] Filed: Jan. 18, 1985

[30] Foreign Application Priority Data

Jan. 20, 1984 [GB] United Kingdom ..... 8401504

[51] Int. Cl.[4] ..... A45D 40/24

[52] U.S. Cl. ..... 206/581; 132/79 F; 206/235; 206/823

[58] Field of Search ..... 132/79 C, 79 F, 79 R, 132/82 A, 82 C, 82 D, 82 E, 82 F, DIG. 3; 206/1.7, 1.8, 37, 38, 369, 372, 373, 581, 823, 235; 220/4 B, 20; 229/2.5 R

[56] References Cited

U.S. PATENT DOCUMENTS

| | | | |
|---|---|---|---|
| 1,282,485 | 10/1918 | Sterling | 206/823 |
| 1,292,350 | 1/1919 | Mentzer | 206/38 |
| 2,233,366 | 2/1941 | MacGregor | 132/79 R |
| 2,485,320 | 10/1949 | Rosenthal | 132/79 C |
| 2,593,896 | 4/1952 | Kollontay | 132/79 R |
| 2,628,625 | 2/1953 | Pike | 132/79 R |
| 2,783,875 | 3/1957 | Shabarick | 220/20 |
| 3,482,728 | 12/1969 | Flax | 132/79 R |
| 3,587,838 | 6/1971 | Miyata | 229/2.5 R |
| 3,605,374 | 9/1971 | Mueller et al. | 206/499 |
| 3,613,697 | 10/1971 | Andrews | 132/79 C |

*Primary Examiner*—William Price
*Assistant Examiner*—Jimmy G. Foster
*Attorney, Agent, or Firm*—Flynn, Thiel, Boutell & Tanis

[57] ABSTRACT

A cosmetic compact comprises a housing with an aperture. A support is mounted within the housing and rotatable about an axis. Cosmetics are located on the outside of the support. When the support is rotated the cosmetics are brought, in turn, to the aperture where they are accessible to the user.

7 Claims, 6 Drawing Figures

CONTAINERS FOR COSMETICS

The present invention relates to improvements in containers for "compacts" for cosmetics.

According to the present invention a cosmetic container comprises a housing with an aperture, a support carrying cosmetics of different types or colours mounted within the housing, and means for moving the support within the housing so as to present different cosmetics or groups of cosmetics in turn at the aperture.

The housing is preferably cylindrical and the aperture may comprise an elongate slot in the cylindrical wall of the housing.

The support may also be generally cylindrical and have the cosmetics arranged about its axis so that rotation of the support about the axis causes the cosmetics to be brought in turn to the aperture. The means for moving the support may comprise a knob connected to the support and projecting from the housing such that rotation of the knob causes rotation of the support within the housing.

The container may also accommodate applicators, such as sponge applicators or brushes, for applying the cosmetics. Conveniently the applicators may be accommodated in recesses in the support. An aperture may be provided in the housing so that the applicator is accessible when the recess in the support is aligned with the aperture in the housing. Several recesses may be provided in the support, each accommodating an applicator, each applicator being accessible when its recess is aligned with the aperture. Preferably there is a recess for an applicator corresponding to each of the cosmetics or groups of cosmetics on the support.

In one preferred form of the invention, the support is formed from a series of trays, each hinged to the adjacent tray, the trays being folded at their hinge connections so as to be disposed around the axis of rotation of the support with the open sides of the trays facing outwardly to accommodate the cosmetics. The tray may conveniently be formed of plastics material. Dividers may project downwardly from the trays to form the recesses in which the applicators are accommodated.

The support may include a blank portion which can be moved into register with the aperture in the housing when the container is not in use.

A blanking off portion may also be provided on the support for closing the applicator aperture when the cosmeter container is not in use.

An embodiment of the invention will now be described by way of example with reference to the accompanying drawings in which.

Figure 1:
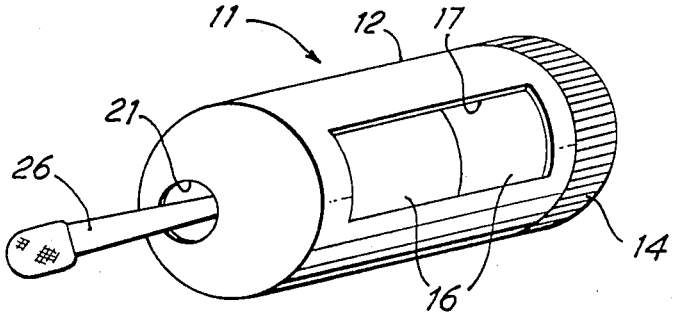
FIG. 1 shows a perspective view of a cosmetic compact in accordance with the invention.

Referring to the drawings, these show a cosmetic compact 11 comprising a cylindrical housing 12 and a generally cylindrical support 13 mounted for rotation about its longitudinal axis within the housing. A knurled knob 14 is secured to one end of the support 13 and projects from one end of the housing 12. The knob can conveniently be gripped between the fingers and turned to cause the support 13 to rotate within the housing 12.

The outside of the support 13 is provided with four shallow trays 15 disposed around the axis of the support. Each tray 15 provides two shallow cavities for receiving cosmetics 16. Different colours or types of cosmetics may be provided in each cavity so that the compact provides a choice of eight colours or types of cosmetic.

An elongate aperture or window 17 is provided in the window sidewall of the housing 12 so that when the support is rotated by means of the knob 14, each tray 15 is presented in turn at the aperture. Thus, two cosmetics 16 are shown at the aperture at a time.

Figure 2:
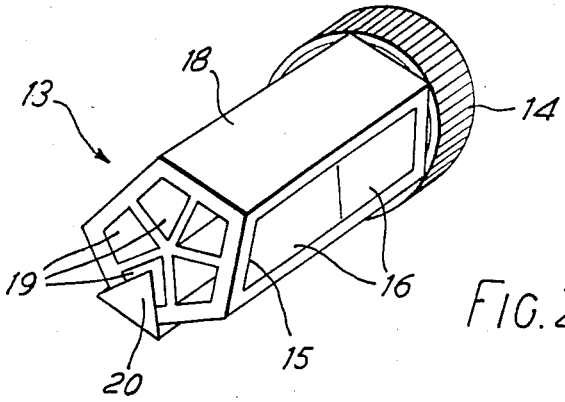
FIG. 2 shows the support member of the cosmetic compact in accordance with the invention.

As can be seen from FIG. 2, the generally cylindrical support 13 has five sides, four of which carry the trays 15, the fifth side 18 being blank. When the compact is not in use, the support is rotated so that the blank side 18 appears in the aperture and the cosmetics 16 in all the trays 15 are protected by the housing 12.

Longitudinally-extending cavities or recesses 19 are provided in the support 13. These cavities accommodate applicators 26 for the cosmetics. There are five recesses in the support but one of the recesses is obscured by a blanking part 20 moulded integrally with the support. This cavity does not accommodate an applicator.

Figure 6:
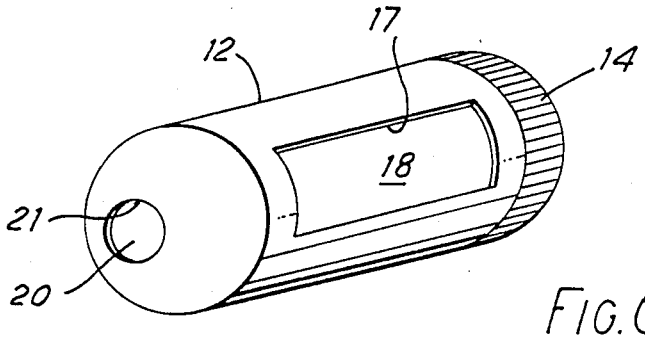
FIG. 6 shows the compact of FIGS. 1 to 5 when not in use.

The end wall of the housing 12 has an aperture 21 to provide access to the applicators. The aperture 21, as shown in FIG. 1, is sidewardly offset from the center of the housing end wall 12'. As the support is rotated to bring a tray of cosmetics to the aperture 17, a corresponding cavity 19 in the support is brought into alignment with the aperture 21 so that the applicator for use with the cosmetics at the aperture 17 is accessible. Thus an applicator may be provided for use individually with the pair of cosmetics in each tray. The position of the blanking part 20 is arranged so that it is aligned with the aperture 21 when the blank side 18 of the support is at the aperture 17. Thus the cosmetic applicators cannot fall out of the aperture 21 when the compact is not in use. FIG. 6 shows the compact in this position.

Figure 3:
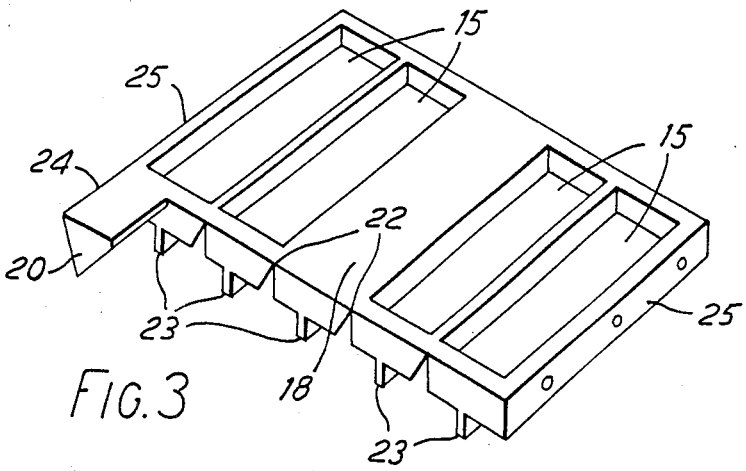
FIGS. 3, 4 and 5 show part of the support in various stages during assembly.
Figure 4:
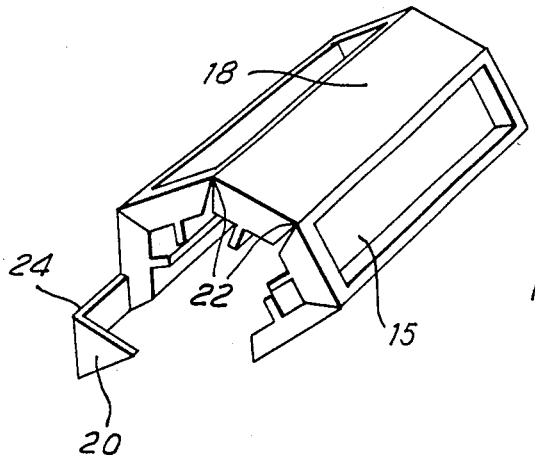
Figure 5:
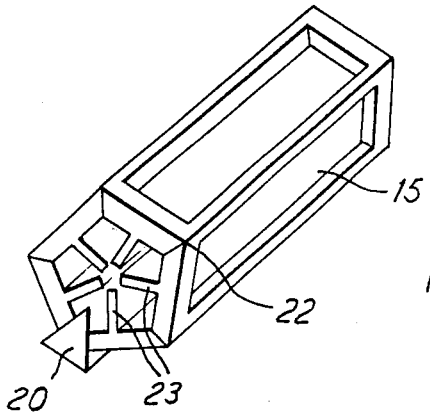

FIGS. 3 to 5 show a convenient way in which the support 13 may be formed. A flat array of four rectangular trays 15 and one blank side 18 is formed by injection moulding from plastics material. Each tray is connected to its neighbour by an integral hinge 22. Dividers 23 project downwardly from the trays and the blank side. A tab 24 projects from one end of one of the trays to form the blanking part 20.

After forming, the flat array of trays is folded at the hinges 22 around a longitudinal axis to form a pentagonal prismatic array, as shown in FIG. 5, with the trays projecting outwardly. The dividers 23 meet at the axis of the support to form the cavities 19. The tab 24 projects over one of the cavities to form the blanking part 20. The abutting longitudinal sides 25 of the end trays clip together to secure the array in the pentagonal configuration.

It is preferred to fill the trays with the cosmetics whilst they are in the flat configuration shown in FIG. 4. This permits conventional flat filling techniques to be used with high-production equipment. Several cavities 15 in the support may thus be filled with different cosmetics at the same time. After the trays have been assembled into the pentagonal configuration the knob 14 is clipped onto the support. The housing 12 is then applied over the support and clipped to the base. Finally the applicators are inserted into the cavities 19.

The compact according to the present invention is simple to manufacture and assemble and simple and convenient to use. The cosmetics are well protected in the container when the compact is not in use.

It will be appreciated that various modifications of the compact are possible. For example, the number of trays and the number of cosmetics in each tray can be varied to suit requirements. The cosmetics may be of various types, for example eye shadow, mascara, powder or lipstick or lip gloss. The cosmetics may be placed directly in the cavities 15 as described above or they may be placed in small pots or godets which are then received in the cavities. Alternatively, where more than one cosmetic is to be placed in each tray, each tray may be moulded with a single cavity which is fitted with a vacuum-moulded liner. The liner is formed with two or more cavities which receive the different cosmetics, either directly or in pots or godets. The applicators may also be of various types to suit the cosmetics, for example sponges, brushes or pad applicators.

All the parts may conveniently be moulded from plastics material.

I claim:

1. A cosmetic container comprising:

support means having a plurality of mutually inclined surfaces, said support means comprising a plurality of trays, and hinge means connecting each tray to an adjacent one of said trays, said trays being folded about said hinge means so that each tray forms one of said mutually-inclined surfaces;

a plurality of cosmetics, a respective one of said cosmetics being located in each of said trays; and a housing having a substantially cylindrical sidewall disposed in surrounding relationship to said support means and being rotatable relative thereto, said support means when disposed in said housing being oriented such that the trays project radially outwardly toward the sleevelike sidewall of the housing relative to the cylindrical axis thereof, said cylindrical sidewall having an elongated aperture formed through the cylindrical sidewall thereof for providing access to at least one of the trays when the latter is radially aligned with the aperture.

2. A cosmetic container comprising:

a housing having a cylindrical wall;

an elongate aperture in said cylindrical wall of said housing, said aperture having its major dimension extending generally parallel to the axis of the cylindrical wall;

support means mounted within said housing, said support means being generally cylindrical and being mounted for rotation about the cylindrical axis of the housing;

a plurality of cosmetics carried by said support means, said cosmetics being disposed around said axis and disposed on said support means so as to face radially outwardly of said axis;

knob means connected to said support means and projecting from said housing so that rotation of said knob about said axis causes rotation of said support means within said housing to present a different one or group of said cosmetics, in turn, at said elongate aperture; and said housing having a generally flat end wall, a second aperture in said flat end wall, said second aperture being radially offset relative to said axis, said support means including at least one recess, at least one cosmetic applicator accommodated in said recess, and said support means being rotatable to bring said recess into alignment with said second aperture whereby said applicator can be removed from said recess.

3. A cosmetic container as claimed in claim 2 wherein said support means carries blanking-off means, said blanking-off means being brought into register with the second aperture by rotation of said support means to close said second aperture when the cosmetics are not in use.

4. A cosmetic container comprising:

a housing having a cylindrical wall, said housing being at least partially closed at one end thereof by an end wall, said end wall having an opening therethrough;

an elongate aperture in said cylindrical wall of said housing, said aperture having its major dimension extending generally parallel to the axis of the cylindrical wall;

support means mounted within said housing, said support being generally cylindrical and being mounted for rotation about the cylindrical axis of the housing;

said housing and said support means being elongated and having a dimension along said axis which is greater than the respective cross-sectional dimension;

said support means having a recess formed in the interior thereof and opening outwardly through the end thereof adjacent said end wall, and a cosmetic applicator being removably positioned within said recess and accessible through the opening formed in the end wall, said recess and said opening being radially offset relative to said axis so that the applicator is accessible through the opening only when the recess and opening are substantially axially aligned;

a plurality of cosmetics carried by said support means, said cosmetics being disposed around said axis and disposed on said support means so as to face radially outwardly of said axis; and knob means connected to said support means and projecting outwardly through the other end of said housing and being manually accessible to permit gripping thereof so that it can be rotated relative to said housing about said axis to cause rotation of said support means within said housing to present a different one or group of said cosmetics, in turn, at said elongate aperture.

5. A cosmetic container comprising:

a housing having a cylindrical wall;

an elongate aperture in said cylindrical wall of said housing, said aperture having its major dimension extending generally parallel to the axis of the cylindrical wall;

support means mounted within said housing, said support being generally cylindrical and being mounted for rotation about the cylindrical axis of the housing;

a plurality of cosmetics carried by said support means, said cosmetics being disposed around said axis and disposed on said support means so as to face radially outwardly of said axis;

knob means connected to said support means and projecting from said housing so that rotation of said knob means about said axis causes rotation of said support means within said housing to present a different one or group of said cosmetics in turn, at said elongate aperture; and said support means comprising a plurality of trays each having an open side for receiving a respective one of said cosmetics, and hinge means connecting each said tray to an adjacent one of said trays, said trays being disposed around the axis of rotation with their open side facing away from the axis of rotation.

6. A cosmetic container as claimed in claim 5 including divider means projecting from said trays towards the axis of rotation to form recesses for receiving cosmetic applicators.

7. A cosmetic container as claimed in claim 5, wherein said support means includes a blank portion, said blank portion being brought into register with said aperture in the housing by rotation of said support means when said cosmetics are not in use.

* * * * *